United States Patent [19]

Tomaszewski

[11] 4,400,248

[45] Aug. 23, 1983

[54] ELECTROLYTIC STRIPPING PROCESS

[75] Inventor: Lillie C. Tomaszewski, Dearborn, Mich.

[73] Assignee: Occidental Chemical Corporation, Warren, Mich.

[21] Appl. No.: 355,506

[22] Filed: Mar. 8, 1982

[51] Int. Cl.[3] ..... C25F 5/00
[52] U.S. Cl. ..... 204/146
[58] Field of Search ..... 204/146

[56] References Cited

U.S. PATENT DOCUMENTS 3,649,489 3/1972 Dillenberg ..... 204/146
3,912,603 10/1975 Mietens ..... 204/146
4,233,124 11/1980 Tomaszewski ..... 204/146

FOREIGN PATENT DOCUMENTS 49-130329 12/1974 Japan ..... 204/146

*Primary Examiner*—T. M. Tufariello
*Attorney, Agent, or Firm*—Richard P. Mueller

[57] ABSTRACT

A process and solution for electrolytically stripping metal deposits, particularly nickel and nickel-iron alloy deposits from a copper or copper alloy basis metal such as brass, for example, in which the aqueous stripping solution contains controlled effective amounts of halide salts, an organic carboxy acid, metal salts and mixtures thereof and hydrogen ions to provide a pH of less than about 5. The stripping of the metal deposit from the basis metal is effected by immersing the object in the stripping bath while anodically charged and passing electric current through the bath between the cathode and the object for a period of time sufficient to achieve the desired magnitude of stripping of the metal deposit.

14 Claims, No Drawings

ELECTROLYTIC STRIPPING PROCESS

BACKGROUND OF THE INVENTION

The present invention is broadly applicable to a process for electrolytically stripping or removing unwanted metallic deposits or platings from substrates, and more particularly, for electrolytically stripping unwanted nickel and nickel alloy plating deposits from cooper and copper alloy basis metals or substrates.

The stripping or removal of nickel and nickel-alloy deposits such as nickel-iron alloy deposits, is ocassionally required when the metal plating is defective or has become mechanically damaged during the handling of the article. By stripping or removing the defective or damaged electrodeposit, the article can be salvaged and subsequently replated to provide a commercially satisfactory article. The stripping of nickel and nickel-alloy metal deposits is of significant commercial importance in the plumbing fixture industry in which the fixtures are comprised of copper or copper alloys, usually brass, over which a bright nickel or nickel-iron alloy plating is deposited to enhance appearance and durability. A problem heretofore associated with the stripping of such nickel and nickel-alloy deposits from copper and copper alloy substrates has been the tendency of the stripping composition or the process for effecting such stripping to cause adverse etching or damage to the substrate necessitating expensive refinishing operations to restore the substrate to a condition in which it can be replated.

In accordance with prior art practices, it has been conventional for stripping nickel and nickel-alloy electrodeposits from copper and copper alloy substrates by employing relatively concentrated acidic solutions such as hydrochloric acid and sulfuric acid alone or in further combination with phosphoric acid to effect a removal of the electrodeposit. Such concentrated acidic solutions have a tendency to etch and pit the basis metal and also present handling and waste disposal problems because of the corrosive nature and high concentration of such stripping solutions.

The process and stripping solution of the present invention overcomes many of the disadvantages and problems associated with prior art techniques by providing a stripping solution which is relatively dilute and therefore less corrosive facilitating its handling and disposal while at the same time providing for an efficient rate of stripping and a lower attack rate on the copper or copper alloy basis metal eliminating etching or pitting of the basis metal. Accordingly, only a light color buffing of the stripped article is usually required to restore its high lustre to enable the replating thereof. Particular benefits are achieved in the stripping of bright nickel and nickel-iron electrodeposits containing up to about 40 percent iron from brass plumbing fixtures enabling a replating thereof to provide a commercially satisfactory product.

SUMMARY OF THE INVENTION

The benefits and the advantages of the present invention are achieved by a process in which nickel and nickel-alloy electrodeposits can be effectively an efficiently removed from copper and copper alloy basis metals in which the article or object to be stripped is immersed in the stripping bath which comprises an aqueous acidic solution containing about 5 to about 200 g/l of a halide salt or mixture thereof, about 10 to about 100 g/l of a bath soluble organic carboxy acid, salt and mixtures there of the structural formula:

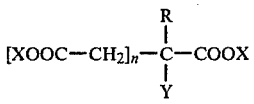

Wherein:

R is H or an alkyl group containing 1 to 4 carbon atoms,

Y is H or OH,

X is H, a Group IA, IIA metal and $NH_4$, n is 0, 1 or 2;

and hydrogen ions to provide a pH less than about 5. The stripping of the object is achieved by anodically charging the object and passing electric current through the stripping bath between a cathode and the object for a period of time to achieve the desired magnitude of stripping of the metal deposit therefrom. The stripping bath is controlled at a temperature ranging from about room temperature up to about 180° F. and the anode current density is controlled with a range of about 100 to 500 amperes per square foot (ASF). The specific time required to effect a substantially complete stripping of the defective electrodeposit will vary depending upon the particular thickness of the electroplate to be stripped, the bath temperature, concentration and current density employed.

Additional benefits and advantages of the present invention will become apparent upon a reading of the Description of the Preferred Embodiments taken in conjunction with the specific examples provided.

DESCRIPTION OF THE PREFERRED EMBODIMENTS

In accordance with the practice of the present invention, a stripping bath is employed comprising an aqueous acidic solution containing as its essential constitutents, controlled and effective amounts of halide salts, an organic carboxylic acid including metal salts and mixtures thereof and hydrogen ions in an amount sufficient to provide a pH of less than about 5. The halide salt may comprise chloride, bromide, iodide and mixtures thereof with metals of group IA and IIA as well as ammonium salts. Of the foregoing, iodide salts are less desirable because of the lower activity of such salts whereas chloride salts, and particularly alkali metal chlorides such as sodium chloride comprise the preferred halide constituents in consideration of both activity, availability, cost and waste disposal. The halide salt or mixture thereof can be employed in amounts ranging from about 5 to about 200 g/l, with amounts of about 20 to 50 g/l being preferred and with amounts of about 30 g/l being typical.

It has been observed that as the halide salt concentration is increased to a level approaching the maximum concentration of about 200 g/l, the rate of attack of the stripping solution on the copper or copper alloy basis metal increases. Surprisingly, however, even at such high halide salt concentrations it has been found that the rate of attack is substantially uniformly distributed over the entire surface area of the basis metal without any significant localized attach and associated deep pitting such as encountered employing prior art-type stripping solutions containing hydrochloric acid or sulfuric acid. Accordingly, even at such high basis metal attack rates, the stripped substrate usually only requires a light color buffing to restore the substrate to a condition in which it can be replated. In some instances, a high rate of attack on the basis metal even though uniform cannot be tolerated such as in the case of precision parts requiring close dimensional tolerances as ememplified by pipe threads on plumbing fixtures. Because of the commercially satisfactory stripping rates attained at lower halide salt concentrations and the associated lower attack rates of the basis metal, it is preferred to control the halide salt concentration within the preferred range of about 20 to about 50 g/l.

The bath soluble organic carboxy acid compound which can be satisfactorily employed corresponds to the structural formula:

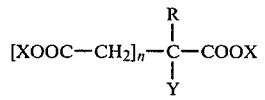

Wherein:

R is H or an alkyl group containing 1 to 4 carbon atoms,

Y is H or OH,

X is H, a Group IA, IIA metal and NH4, n is 0, 1 or 2;

Organic carboxy acids corresponding to the foregoing formula include formic, acetic, succinic, glycolic, lactic and citric acid of which glacial acetic acid is preferred. It is also preferred to add the carboxy acid compound in the form of the acid itself to provide hydrogen ions to attain acidic medium.

The stripping bath further contains hydrogen ions which may be suitably introduced by a halide acid of which hydrochloric acid constitutes a preferred material to provide a pH of less than about 5 with a pH of about 0.8 to about 1.5 being preferred.

The stripping of bright nickel or a bright nickel-iron alloy containing up to about 40 percent iron from a copper or copper alloy basis metal such as a brass substrate is achieved by immersing the object or article to be stripped in the stripping solution and anodically charging the article so as to effect a flow of current between a cathode and the article. During the stripping operation, it is preferred that relative agitation between the article being stripped and the solution is effected in order to avoid stratification of the bath. For this purpose, mild agitation such as anode bar agitation, mild air agitation or circulation of the solution such as by pumping or mechanical agitation has been shown to be satisfactory. The electrolytic stripping of the article is usually performed at an anode current density ranging from about 10 to about 500 ASF or higher depending upon the limitations of the rectification equipment and conductivity of the solution. Generally, average anode current densities of about 100 to about 300 ASF are commercially employed and provide for efficient and effective stripping of the nickel or nickel-alloy electrodeposit from the substrate. The operating temperature of the bath may range from about room temperature (70° F.) up to about 180° F. with temperatures of about 100° to about 140° being preferred while a temperature of about 120° F. is typical.

the cathode employed in the stripping bath may be of any suitable composition and preferably comprises a nickel plated mild steel cathode of a total surface area preferably greater than about four times the surface area of the part or parts to be stripped to attain the requisite current density and efficiency in the electrolytic stripping operation. The specific time required for effecting a stripping of the electrodeposit from the substrate will vary as a function of the thickness of the original electrodeposit, the configuration of the plated article being stripped, the concentration of the stripping bath within the parameters as hereinabove set forth, the temperature and the current density employed.

The process of the present invention has been found eminently suitable for the electrolytic stripping of defective or damaged bright nickel and bright nickel-iron alloy electrodeposits from brass plumbing fixtures or the like whereby efficient and effective removal of such electrodeposits is achieved without damage to the brass substrate requiring only a light color buffing to restore the high lustre of the brass substrate prior to replating.

In order to further illustrate the process of the present invention, the following examples are provided. It will be understood that the examples are provided for illustrative purposes and not intended to be limiting of the scope of the present invention as herein described and as set forth in the subjoined claims.

EXAMPLE 1

In order to evaluate the rate of attack of the electrolytic stripping solution on a brass basis metal, a polished brass test panel having a total surface area of 10 square inches is placed in a beaker containing 500 milliliters of an aqueous acidic stripping solution containing 26.2 g/l glacial acetic acid and variable amounts of sodium chloride. In the first run, the stripping solution contained 30 g/l sodium chloride; in the second run the sodium chloride concentration was 60 g/l; in the third run the stripping solution containing 90 g/l sodium chloride; in the fourth run the stripping solution contained 120 g/l sodium chloride. The unplated polished brass test panel is immersed in each of the four stripping solutions controlled at a temperature of about 120° F. and at a pH of about 2 by the addition of hydrochloric acid and is electrified anodically to provide for an anode current density of about 100 ASF. A nickel plated mild steel cathode having a total surface area of about 32 inches is employed in the bath.

Each brass test panel is weighed prior to initiation of the electrolysis and is reweighed at the completion of a 15 minute run. The weight loss established for each test panel is calculated in terms of loss in thickness of the test panel in terms inches per minute. In accordance with the foregoing test procedure, the rate of attack of the brass basis metal as a function of sodium chloride concentration is as follows:

| Composition | | |
|---|---|---|
| Acetic Acid | NaCl | Rate of Attack, inch/minute |
| 26.2 g/l | 30 g/l | 0.0000071 |
| 26.2 g/l | 60 g/l | 0.000014 |
| 26.2 g/l | 90 g/l | 0.000029 |
| 26.2 g/l | 120 g/l | 0.000031 |

EXAMPLE 2

An aqueous acidic stripping stolution is prepared containing 26.2 g/l glacial acetic acid, 30 g/l sodium chloride and the pH is adjusted to about 2 employing hydrochloric acid. A fist series of unplated polished brass test panels of the type described in Example 1 is employed to determine the rate of attack on the basis metal with varying anode current densities. A second series of polished brass test panels provided with 0.5 mil (0.0005 inch) bright nickel electroplate is subjected to stripping employing the same stripping solution and at varying anode current densities. The rate of attack on the basis metal is calculated as described in Example 1 while the rate of stripping of the nickel plate is determined by the weight loss of the panels at the completion of a five minute stripping test run calculated in terms of inches per minute. The stripping rate of the nickel electrodeposit and the rate of attack of the brass basis metal at current densities of 100, 150, 200 and 300 ASF is set forth in the following table:

| Anode Current Density, ASF | Stripping Rate, Inch//minute | Rate of Attack, Inch/minute |
|---|---|---|
| 100 | 0.000082 | 0.000009 |
| 150 | 0.000126 | 0.0000086 |
| 200 | 0.00016 | 0.0000102 |
| 300 | 0.000187 | 0.000012 |

EXAMPLE 3

For comparative purposes, an aqueous acid stripping bath is prepared in accordance with prior art practice containing 15 g/l hydrochloric acid (22° Be') and nickel plated and polished unplated brass test panels of the same type described in Example 2 are tested to evaluate the stripping rate of the nickel deposit and the rate of attack of the brass basis metal at 100 ASF anode current density under the same conditions as described in Example 2. Employing the prior art control stripping solution, the stripping rate of the nickel deposit is calculated to be 0.000058 inch per minute and the rate of attack is calculated to be 0.000016 inch per minute. A comparison of these results with the results obtained at the 100 ASF anode current density test of Example 2 reveals the control solution to have a significantly lower stripping rate of the nickel deposit and a significantly higher rate of attack of the brass basis metal.

Perhaps more importantly, the prior art control stripping solution results in severe pitting of the brass basis metal rendering the stripped panel unsuitable for replating without major surface refinishing operations to restore it to a platable condition. In contrast and surprisingly, the use of the aqueous acidic stripping solution as exemplified in Example 2 even at the relatively high sodium chloride concentrations, i.e. above about 100 g/l, and the associated higher rates of attack produces a stripped panel which is uniformly attacked and without any detrimental localized pitting requiring only a light color buffing in most instances to restore the panel to a platable condition.

EXAMPLE 4

An aqueous acidic stripping solution is prepared employing 100 g/l sodium chloride, 20 g/l sodium bromide, 20 g/l citric acid and the pH of the solution is adjusted to about 1.5 with hydrochloric acid. Nickel plated brass test panels of the type described in Example 2 employing the arrangement of Example 2 are subjected to electrolytic stripping at a solution temperature of about 70 to about 80° F., an anode current density of 100 ASF employing a nickel plated mild steel cathode. The stripping rate of the nickel deposit is satisfactory with no visible etching or pitting of the brass substrate.

EXAMPLE 5

An aqueous acidic stripping bath is prepared containing 100 g/l sodium chloride, 10 g/l citric acid and the pH is adjusted to about 0.8 to about 1.5 with hydrochloric acid. Bright nickel plated brass test panels are stripped in accordance with the conditions described in Example 4 with similar satisfactory results.

EXAMPLE 6

An aqueous acidic stripping bath is prepared containing 100 g/l sodium chloride, 10 milliliters per liter (88 percent) lactic acid (10.9 g/l) and the pH is adjusted within a range of 2.2 to 3.6 employing hydrochloride acid. Bright nickel plated test panels are stripped in accordance with the procedure as described in Example 4 with similar satisfactory results.

EXAMPLE 7

An aqueous acidic stripping bath is prepared containing 100 g/l sodium chloride, 20 g/l succinic acid and ph is ajusted to about 5. Bright nickel plated brass test panels are immersed and electrolytically stripped in the stripping bath under the conditions as described in Example 4 with similar satisfactory results.

EXAMPLE 8

An aqueous acidic stripping bath is prepared containing 100 g/l sodium chloride, 20 milliliters per liter glycolic acid (10 g/l) and pH is adjusted within a range of 3.5 to 5. Bright nickel plated brass test panels are stripped in the stripping bath under the conditions as described in Example 4 with similar satisfactory results.

EXAMPLE 9

An aqueous acidic stripping solution is prepared containing 25 g/l glacial acetic acid, 30 g/l sodium chloride and the pH is adjusted to about 0.8 to about 1.5 with hydrochloric acid. A series of polished brass test panels provided with 0.5 mil (0.0005 inch) bright nickel-iron alloy electroplate containing about 30 percent by weight iron are electrolytically stripped employing a nickel plated mild steel cathode at a cathode to anode ratio of 4:1, an anode current density of 100 ASF and a solution temperature ranging from room temperature up to about 100° F.

The stripping rate of the nickel-iron alloy electroplate calculated in accordance with the procedure as set forth in Example 2 is 0.00008 inch per minute. The attack of the brass basis metal is minimal requiring only a light color buffing to restore the lustre of the panel.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. A process for electrolytically stripping nickel and nickel-iron alloy deposits from copper and copper alloy basis metals which comprises the steps of immersing an object to be stripped in a stripping bath comprising an aqueous acidic solution consisting of about 5 to about 200 g/l halide salt, about 10 to about 100 g/l of a bath soluble organic carboxy acid, salt and mixtures thereof of the structural formula:

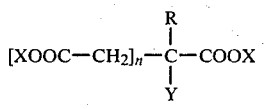

Wherein:

R is H or an alkyl group containing 1 to 4 carbon atoms,

Y is H or OH,

X is H, a Group IA, IIA metal and $NH_4$, n is 0, 1 or 2;

and hydrogen ions to provide a pH less than about 5, controlling the temperature of said bath between room temperature up to about 180° F., anodically charging the object and passing electric current through the solution between a cathode and the object for a period of time to achieve the desired magnitude of stripping of the metal deposit from the object.

2. The process as defined in claim 1 in which the step of controlling the temperature of said bath is performed to provide a temperature between about 100° to about 140° F.

3. The process as defined in claim 1 in which the step of controlling the temperature of said bath is performed to provide a temperature of about 120° F.

4. The process as defined in claim 1 in which the step of passing electric current through the solution between a cathode and the object is performed at an anode current density of about 10 to about 500 ASF.

5. The process as defined in claim 1 in which the step of passing electric current through the solution between a cathode and the object is performed at an average anode current density of about 100 to about 300 ASF.

6. The process as defined in claim 1 including the further step of controlling the anode to cathode ratio at at least about 1:4.

7. The process as defined in claim 1 in which said hydrogen ions are present to provide a pH of about 0.8 to 1.5.

8. The process as defined in claim 1 in which said halide salt comprises a halide selected from the group consisting of chloride, bromide, and mixtures thereof.

9. The process as defined in claim 8 in which said halide salt comprises a salt of an alkali metal, ammonium and mixtures thereof.

10. The process as defined in claim 1 in which said halide salt is present in an amount of about 20 to about 50 g/l.

11. The process as defined in claim 1 in which said halide salt is present in an amount of about 30 g/l.

12. The process as defined in claim 1 in which said organic carboxy acid, salt and mixtures thereof is present in an amount of about 20 to about 50 g/1.

13. The process as defined in claim 1 in which said organic carboxy acid is an acid selected from the group consisting of formic, acetic, succinic, glycolic, lactic and citric acid.

14. The process as defined in claim 1 in which said organic carboxy acid comprises acetic acid.

* * * * *